United States Patent [19]

Musil

[11] 4,395,129

[45] Jul. 26, 1983

[54] FEED SYSTEM FOR ASPHALT RECYCLING DRUM MIXERS

[75] Inventor: Joseph E. Musil, Ely, Iowa

[73] Assignee: Iowa Manufacturing Company of Cedar Rapids, Iowa, Cedar Rapids, Iowa

[21] Appl. No.: 345,565

[22] Filed: Feb. 4, 1982

[51] Int. Cl.[3] ..... B28C 1/22; B28C 5/20; B28C 5/46

[52] U.S. Cl. ..... 366/25; 366/57; 366/228; 366/233

[58] Field of Search ..... 366/4, 7, 24, 25, 26, 366/12, 15, 40, 56, 57, 58, 225, 228, 229, 233, 235; 432/106–108; 34/108, 127, 128, 129

[56] References Cited

U.S. PATENT DOCUMENTS 3,999,743 12/1976 Mendenhall .

4,147,436 4/1979 Garbelman et al. ..... 366/25

4,165,184 8/1979 Schlarmann ..... 366/12

4,215,941 8/1980 Mendenhall ..... 366/25

*Primary Examiner*—Philip R. Coe

*Assistant Examiner*—Timothy F. Simone

*Attorney, Agent, or Firm*—Haven E. Simmons

[57] ABSTRACT

A drum mixer for recycling old asphalt pavement features a stationary shroud enveloping a series of circumferentially spaced feed ports medially of the drum. The old pavement is introduced tangentially into the shroud and thence into a series of "hoppers" within the shroud formed about the feed ports and revolving with the drum. The old pavement falls through the feed ports onto the exterior of a conical inner drum and is directed to the downstream end of the latter by flighting thereon where it joins virgin aggregate emerging from the interior of the inner drum.

4 Claims, 4 Drawing Figures

FEED SYSTEM FOR ASPHALT RECYCLING DRUM MIXERS

BACKGROUND OF THE INVENTION

Reuse or recycling of old asphalt pavement is much in vogue these days. The old pavement is first removed and sized to produce an aged mix or "RAP", as it is often called. To produce a recycled mix the RAP is then combined with fresh or virgin aggregate, "VAM" as it too is often called, and new liquid asphalt, all typically in apparatus of the drum mixer nature. One of the problems inherent in this type of apparatus is to prevent the hot flame of the burner from firing or coking the old asphalt in the RAP before the latter joins the VAM and the fresh asphalt. Not only does coking of the old asphalt damage it but also produces excessive clouds of odious smoke forbidden by environmental regulations. Consequently, the almost universal practice nowadays is to introduce the RAP at a point well downstream of the burner in order to shield the RAP as much as possible.

One technique of performing this is described in U.S. Pat. No. 4,165,184 to Schlarmann in which a cylindrical inner drum extends part way down the main drum through its upstream end, the flame of the burner and the VAM entering the inner drum while the RAP enters the annular space between the two drums. The RAP is thus shielded from direct contact with the flame until it joins the VAM well downstream of the burner. Added advantages are that the RAP is heated by the hot exterior surface of the inner drum before it joins the VAM and the lesser diameter of the inner drum increases the "veil" of VAM across the flame in order further to protect the RAP. The Schlarmann arrangement performs well enough in many instances, but it was later discovered that if the plant is operated at high production rates it is difficult to get sufficient VAM through the inner drum owing to its lesser diameter. At the same time the consequent increased air velocity through the inner drum tends to entrain too many fines from the VAM. Furthermore, it turned out that if the plant is operated with RAP quantities in excess of fifty percent or so of the total, the proportionately lesser quantity of VAM reduced its screening effect or "veil" across the inner drum enough so that the RAP, even though not exposed to direct flame until well downstream of the burner, was nevertheless inadequately protected from coking.

Subsequent to Schlarmann there appeared the earlier of two versions of a recycle drum mixer combining in effect the Schlarmann principle and that, for example, of U.S. Pat. No. 3,999,743 to Mendenhall. In the latter patent the RAP is introduced midway or so down the drum through circumferentially spaced feed ports through the drum wall, the ports being enveloped by a shroud within which scoops attached to the drum revolve. That earlier version of a recycle drum mixer just referred to likewise features similar feed ports and an enveloping shroud intermediate the ends of the drum but also includes a short conical inner drum disposed with its smaller end directed downstream. The RAP entering the feed ports falls upon the larger upstream end of the inner drum which abuts the inner wall of the outer drum. As in Schlarmann the RAP is thereupon heated and falls off the downstream end of the inner drum to join the heated VAM, the RAP being thereby shielded from the burner by the inner drum until that occurs. No flighting is used on either the interior or exterior of the inner drum. Also, as in Schlarmann, the smaller downstream end of the inner drum increases the density of the "veil" of the VAM across the burner flame just upstream of the junction of the VAM and the RAP. However, only one side wall of the shroud concerned is stationary, its remaining side and circumferential walls being fixed to and revolving with the drum. Not only is sealing between the stationary and revolving parts of the shroud consequently more difficult, but the RAP must enter the shroud through its stationary side wall. This is accomplished by a feed chute that opens into the shroud tangentially. Thereupon, a series of angled flights carried by the outer drum and the two revolving walls of the shroud direct the RAP into the feed ports from which it falls onto the inner drum. However, since those flights are fixed to the revolving portions of the shroud there is no cleaning action by them upon the two walls involved which thereby can become caked with RAP. Furthermore, the RAP entering the shroud must make two right angle turns, first from the feed chute through the stationary side wall of the shroud and then from the interior of the latter into the feed ports.

In the later version of the same apparatus, flighting is provided on the interior, but not on the exterior, of the inner drum, the feed chute is moved to atop the stationary shroud side wall, and the angled flights are omitted. Instead, a series of angle blades attached to the revolving circumferential wall of the shroud and aligned with the edges of the feed ports are relied upon to direct the RAP into the ports. While this arrangement eliminates the second right angle turn the RAP must take in the earlier version yet caking of the interior of the shroud and the lack of self-cleaning action are still present. Furthermore, in both versions any RAP which does not immediately fall into the feed ports when it enters the shroud must then be carried around within the shroud during one or more revolutions of the drum which also adds to wear and caking of the shroud. And, since no flighting is used on the exterior of the inner drum, in either version, considerable RAP, instead of moving downstream of the inner drum, slides circumferentially of the latter directly into the bottom of the outer drum, impairing its heating and mixing with the VAM.

Returning now to the Mendenhall patent mentioned above and others of his, see for example, U.S. Pat. No. 4,215,941, the shroud about the feed ports is stationary. The scoops revolve within the shroud, pick up the RAP introduced into the shroud, carry it around the latter, and finally dump it into the feed ports, causing considerable wear as well as caking on the interior of the shroud since the RAP travels nearly the entire circumference of the shroud before entering the ports. A later modification of that approach is shown in U.S. Pat. No. 4,147,436 to Garbelman et al. in which the scoops are replaced with paddle-like devices called "funnels" and the feed ports equipped with hinged covers which prevent material in the bottom of the drum from falling back into the shroud through the ports. This avoids some of the previous wear and caking of the shroud but the covers often stick, are themselves subject to wear from the VAM passing over them as it joins the RAP and besides are relatively cumbersome and expensive. Another variation of the Mendenhall approach also uses a stationary shroud but fits chutes to the ports which angle back along the inner wall of the drum in a trailing direction relative to its rotation. But these chutes too are subject to high wear by the passing VAM which in addition can fall back through the chutes into the shroud. Moreover, in all the arrangements just mentioned the shroud must seal against the hot surface of the drum since the area of the latter concerned is not shielded from the burner flame. Nor is there any heating or shielding of the RAP before it joins the VAM.

SUMMARY OF THE INVENTION

The present invention constitutes a different approach to feeding the RAP medially into a drum mixer. A conical inner drum and a stationary shroud are employed, but the RAP enters the shroud tangentially through its circumferential wall where it falls directly into one or more of a series of "hoppers" formed about circumferentially spaced feed ports through the outer drum. These "hoppers" are formed by a pair of annular side walls within the shroud bounding the upstream and downstream edges of the feed ports and by a series of skewed deflectors, the side walls and deflectors revolving with the drum. The deflectors extend between the annular side walls and between the circumferential wall of the shroud and the trailing edge (with respect to the direction of drum rotation) of the feed ports. Consequently, little if any RAP can fall into the bottom of the shroud, and the little that does so is prevented from caking the interior of the shroud by appropriate "scrapers" secured to the annular side walls and one or more of the deflectors. In addition, the shroud if formed in three parts bolted together so that it can be easily removed for interior cleaning if necessary. Finally, the exterior as well as the interior of the inner drum is provided with flighting to direct the RAP in a downstream direction over the exterior surface of the inner drum and so prevent it from sliding circumferentially of the latter into the bottom of the outer drum. The interior flighting of the inner drum closely adjoins that on the interior of the main or outer drum so that there is no interruption of flighting and hence heat transfer through the area in which the RAP is introduced. The flighting on the exterior of the inner drum in turn increases heat transfer to the RAP from the inner drum and improves its mixing with the VAM emerging from the interior of the latter drum.

DETAILED DESCRIPTION OF THE PREFERRED EMBODIMENT

Figure 1:
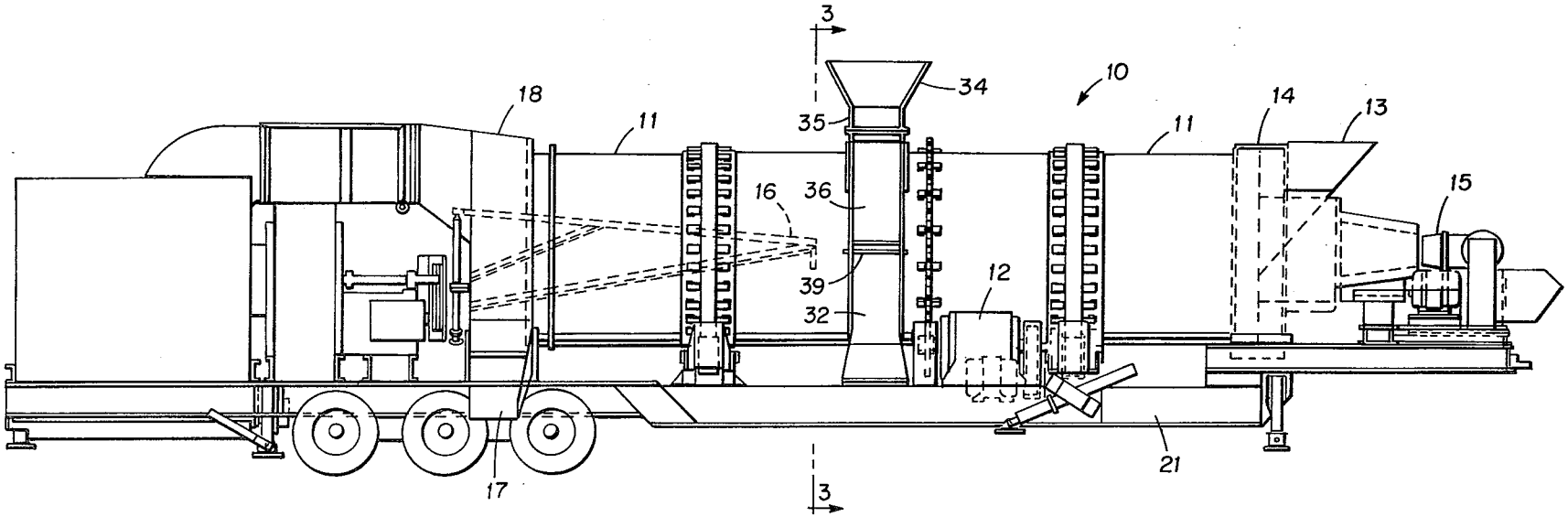
FIG. 1 is a side elevation of a drum mixer fitted with the recycle apparatus of the present invention.
Figure 3:
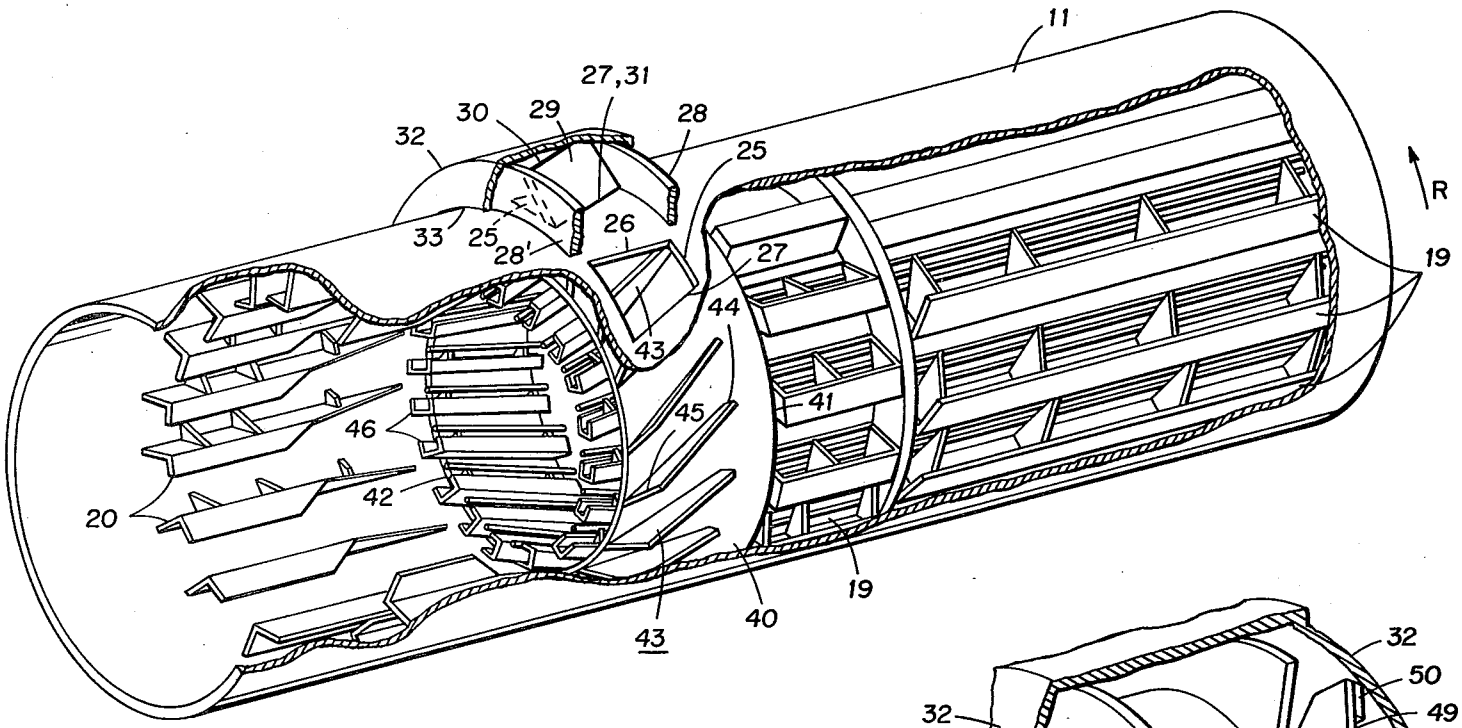
FIG. 3 is a perspective view of the medial portion of the drum mixer of FIG. 1, certain parts being broken away and others omitted for better clarity and understanding of the invention.

The drum mixer 10 depicted in FIG. 1 consists essentially of an outer cylindrical drum 11 rotated about its axis by a motor 12. Virgin aggregate ("VAM") is introduced at 13 at the upstream end 14 of the drum 11 adjacent the burner 15 which injects its flame axially in a downstream direction. Fresh asphalt is added at 16 and the recycled mix exits the drum 11 through a chute 17 at its downstream end 18. The entire interior of the drum 11 is fitted with successive sets of flighting 19 and 20, some of which are shown in FIG. 3, which when the drum 11 is inclined by elevating the forward end of the base frame 21, serves to move material through the drum 11 in a downstream direction. All of this and other details of the construction and operation of the mixer 10, apart from those pertaining particularly to the invention itself, are conventional and well-known so need not be further described.

Figure 2:
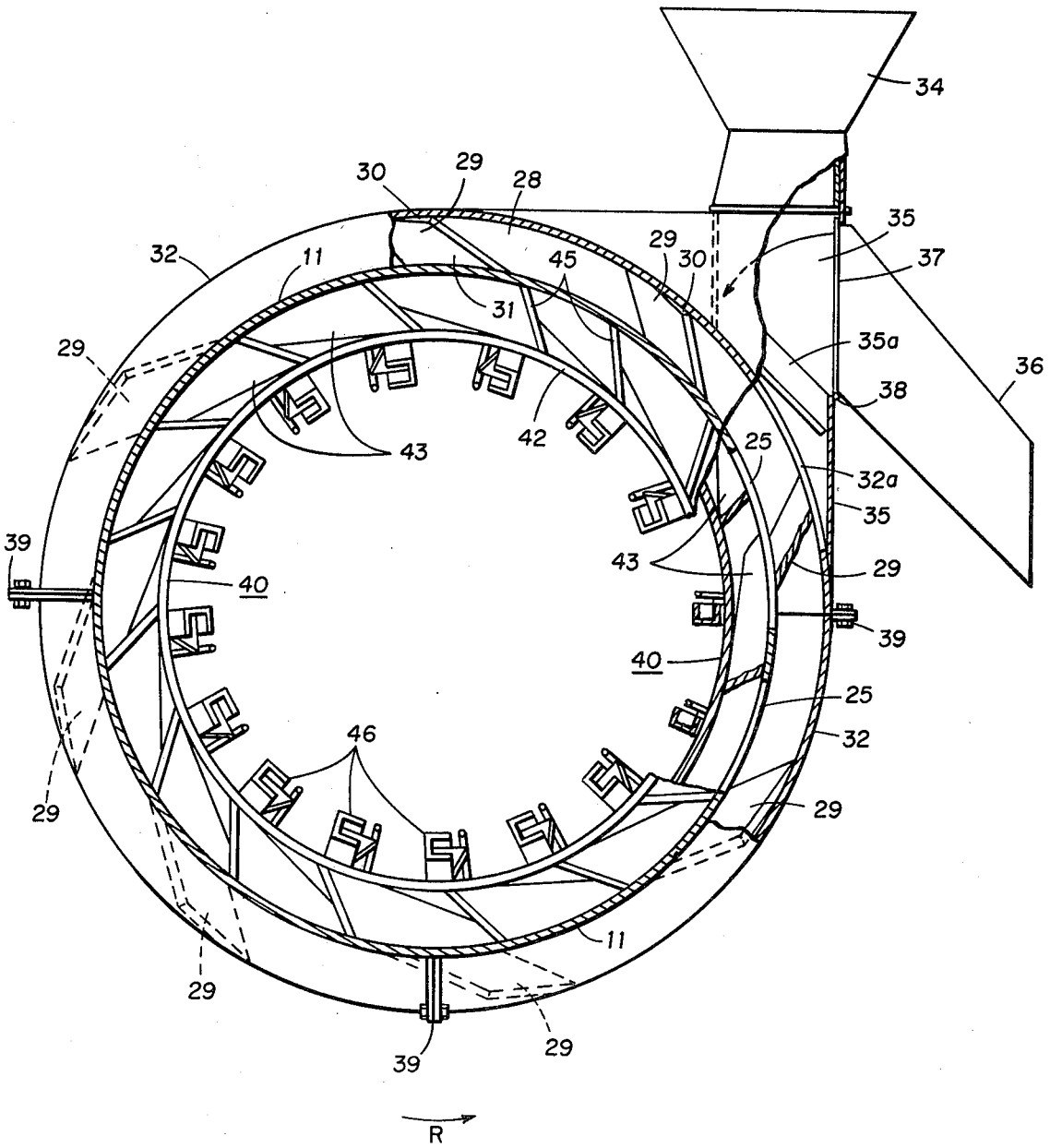
FIG. 2 is a sectional view taken along the line 2—2 of FIG. 1, certain parts being further broken away to illustrate the relationship of the feed ports to the deflectors.

The mid-point or so of the drum 11 is apertured to provide a series of circumferentially spaced feed ports 25 (see FIGS. 2 and 3), a total of 8 being used in the embodiment concerned. Each feed port 25 includes a leading edge 26 parallel to the drum axis and a trailing edge 27, preferably skewed as shown with respect to the drum axis, the terms "leading" and "trailing" being used here and later with regard to the direction of drum rotation indicated by the arrow R. The remaining edges of the ports 25 are bounded by a pair of annular side walls 28, secured to the drum wall 11, between which are fixed a series of deflectors 29. The latter are equal in number to the feed ports 25 and are of plate form, having leading and trailing ends 30 and 31. Each deflector 29 is also skewed, as shown in FIGS. 2 and 3, and its trailing end 31 adjoins the trailing edge 27 of its respective port 25. The side walls 28 and deflectors 29, which thereby form a kind of "hopper" around each feed port 25, revolve with the drum 11 in a channel formed by a stationary annular shroud 32 carried by the base frame 21, the deflector leading ends 30 closely abutting the inner circumferential wall of the shroud 32 and the latter being sealed to the drum wall 11 by appropriate annular lip seals 33 (see FIG. 3). Aged mix ("RAP") enters the shroud 32 tangentially, as shown in FIG. 2, on that side of the drum where the deflectors 20 are ascending during drum rotation. A hopper 34 is provided for this purpose and leads down into the shroud 32 through a chute 35 and an appropriate opening **32*a* in the circumferential wall of the shroud 32. The lower end of the chute 35 is provided with a pair of inclined baffles 35*a* (only one being shown in FIG. 2) to direct the RAP between the annular side walls 28. The outboard face of the chute 35 is fitted with a RAP bypass chute 36 and a gate 37 hinged at 38 to swing as indicated by the arrow in FIG. 3 so as to close off entry into the shroud 32 and divert the RAP down the bypass chute 36. The chute 36 is used in connection with calibrating the conveyor feeding the RAP into the hopper 34. In order to provide for cleaning of the interior of the shroud 32 should that be necessary, the latter is preferably fashioned in three arcuate sections bolted together at 39 as shown in FIGS. 1 and 2**.

Figure 4:
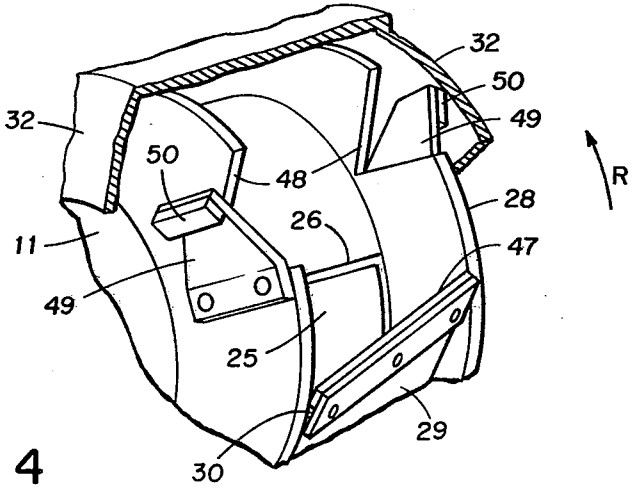
FIG. 4 is a detail perspective view illustrating the manner in which the interior of the shroud is kept clean.

Within the outer drum 11 is disposed a conical inner drum 40 in axial alignment with the former and closely abutting the adjacent drum flighting 19 and 20. The larger or upstream end 41 of the drum 40 abuts and is welded to the inner face of the drum 11 such that the feed ports 25 open onto the upstream portion of the drum 40, the downstream end 42 of the drum 40 thus being well inboard of the inner face of the drum 11. In the annular space thus formed a series of renewable triangular flights 43 are bolted to the outer face of the drum 40 and closely abut the inner face of the drum 11, the flights 43 being skewed as shown in FIG. 3 in the same manner as the feed port trailing edges 27, whence the leading and trailing ends 44 and 45 of the flights 43 correspond to the upstream and downstream ends 41 and 42 of the drum 40. There are preferably twice as many flights 43 as feed ports 25 and the former are arranged so that each port 25 straddles one flight 43, as shown in FIG. 3. Finally, the inner face of the drum 40 is equipped with short flighting 46, similar to the flighting 19. In order to cleanse the interior of the shroud 32 (see now FIG. 4) to the small extent that may be necessary, the leading end 30 of one deflector 29 (or more if necessary) is shortened and equipped with an appropriate scraper blade 47 bolted to its trailing face which engages the interior of the circumferential wall of the shroud 32. Adjacent the blade 47 the annular side walls 28 are oppositely notched at 48 and fitted with outboardly splayed brackets 49 to whose outer ends are secured scrapers 50 which engage the interiors of the side walls of the shroud 32.

Accordingly, RAP entering the hopper 34 and chute 35 passes into the shroud 32 through its opening 32*a* and is immediately directed into the feed ports 25 by the baffles 35*a*, the annular sidewalls 28 and the deflectors 29 as the latter pass the lower end of the chute 35, whence little if any RAP works its way into the bottom of the shroud 32 or needs be carried around a further time or times by the deflectors 29 before finally entering the ports 25. Once through the latter the RAP then falls onto the outer face of the inner drum 40 in the spaces between its flights 43, the latter preventing the RAP from sliding circumferentially around the drum 40 and into the bottom of the drum 11 directly below the drum 40. Instead, the RAP slides downstream along the flights 43, being thereby partially heated by the hot surface of the drum 40, and off its downstream end 42 to join the VAM exiting the interior of the drum 40 in a protective "veil" formed by the flighting 46. The fresh asphalt emitted at 16 is introduced into the combined RAP and VAM at the upstream end of the flighting 20 and after thorough mixing the recycled mix is discharged from the drum 11 through the chute 17.

Relative dimensions are not critical. As an example, for an outer drum of, say, 30 feet in length and 8 feet in diameter, the smaller diameter of the inner drum may be 5½ feet and its slant height 3½ feet. The number of feed ports and flights on the exterior of the inner drum may also be varied without departing from the invention. Hence, though the latter has been described in terms of a particular embodiment, being the best mode known of carrying out the invention, it is not limited to that embodiment alone. Instead the following claims are to be read as encompassing all adaptations and modifications of the invention falling within its spirit and scope.

I claim:

1. In a drum mixer for recycling old asphalt pavement which has been removed and sized to produce an aged mix, the mixer including a cylindrical outer drum having upstream and downstream ends; means for rotating the outer drum about its axis; burner means at the outer drum upstream end for injecting hot gases axially into the outer drum towards its downstream end; means for introducing virgin aggregate into the outer drum adjacent its upstream end; means for introducing aged mix into the outer drum at a medial location thereon downstream of the virgin aggregate introducing means, the aged mix introducing means including a plurality of feed ports through the outer drum spaced circumferentially therearound, a conical inner drum within and fixed to the outer drum in axial alignment therewith, the large and small ends of the inner drum constituting upstream and downstream ends thereof corresponding to said ends of the outer drum, the feed ports opening radially onto the exterior of the inner drum adjacent its upstream end and having leading and trailing edges with respect to the direction of drum rotation, a stationary shroud of generally annular configuration surrounding the exterior of the outer drum and the feed ports effective to define an enclosed channel of annular configuration between the shroud and the feed ports, the shroud including a circumferential wall, and a hopper associated with the shroud for introducing aged mix into said channel, aged mix from the hopper entering the shroud circumferential wall tangentially thereof; means in conjunction with rotation of the outer drum for moving virgin aggregate and aged mix in a downstream direction through the interiors of the outer and inner drums including flighting arranged about the interiors of the outer and inner drums; and means for introducing fresh asphalt into the interior of the outer drum downstream of the inner drum, the improvement comprising: a pair of annular side walls in said channel and carried upon the outer drum wall, the side walls being respectively disposed upstream and downstream of the feed ports and in close proximity to the interior of the shroud; a plurality of aged mix deflectors disposed in said channel, the deflectors being carried upon and rotating with the outer drum relative to the shroud, the deflectors having leading and trailing faces and ends with respect to the direction of drum rotation, each deflector being secured between the annular side walls and disposed in close proximity to the interior of the shroud and one of the feed ports effective so that aged mix introduced into the shroud from the hopper is immediately directed by the annular side walls and the deflector leading face into the associated feed port and onto the exterior of the inner drum during drum rotation; and a plurality of flights circumferentially spaced about the exterior of the inner drum between the same and the outer drum interior, the flights having upstream and downstream ends corresponding to said ends of the inner drum such that aged mix passing through the feed ports contacts the flights adjacent their upstream ends and is directed therealong and the exterior of the inner drum to the downstream ends of the flights and the inner drum, aged mix thereupon joining virgin aggregate emerging from the interior of the inner drum during drum rotation, the flights extending in skewed relation to the drum axis so that said flight upstream and downstream ends constitute leading and trailing ends of the flights with respect to the direction of drum rotation, the deflectors and the trailing edges of the feed ports also extending in skewed relation in the same direction to the drum axis as are said flights, the trailing ends of the deflectors abutting respective ones of the trailing edges of the feed ports.

2. The mixer of claim 1 wherein the number of flights on the exterior of the inner drum is greater than the number of feed ports.

3. The mixer of claim 2 wherein the number of said flights is twice the number of said ports, each of said ports straddling one of said flights.

4. The mixer of claim 3 including a bypass chute and a hinged bypass gate associated with the hopper for diverting aged mix in the hopper into the bypass chute instead of the shroud.

* * * * *